US012599811B2

(12) United States Patent
Stimpson et al.

(10) Patent No.: US 12,599,811 B2
(45) Date of Patent: Apr. 14, 2026

(54) TWO-HANDED DUMBBELL GRIP

(71) Applicants: William K. Stimpson, Kuna, ID (US); Penne M. Stimpson, Kuna, ID (US)

(72) Inventors: William K. Stimpson, Kuna, ID (US); Penne M. Stimpson, Kuna, ID (US)

( * ) Notice: Subject to any disclaimer, the term of this patent is extended or adjusted under 35 U.S.C. 154(b) by 58 days.

(21) Appl. No.: 18/938,465

(22) Filed: Nov. 6, 2024

(65) Prior Publication Data

US 2025/0144469 A1 May 8, 2025

Related U.S. Application Data

(60) Provisional application No. 63/596,777, filed on Nov. 7, 2023.

(51) Int. Cl.
*A63B 23/035* (2006.01)
*A63B 21/00* (2006.01)
*A63B 21/072* (2006.01)

(52) U.S. Cl.
CPC .... *A63B 23/03525* (2013.01); *A63B 21/0726* (2013.01); *A63B 21/4035* (2015.10)

(58) Field of Classification Search
CPC ..... A63B 23/03525; A63B 21/0726; A63B 21/4035; A63B 2210/50; A63B 21/0722; A63B 21/0004; A63B 21/072–08
See application file for complete search history.

(56) References Cited

U.S. PATENT DOCUMENTS

| | | | | |
|---|---|---|---|---|
| 4,743,017 | A | 5/1988 | Jaeger | |
| 8,267,841 | B1 * | 9/2012 | Allison | A63B 21/075 482/106 |
| 8,506,461 | B2 | 8/2013 | Huang | |
| D731,009 | S | 6/2015 | Preston | |
| 11,698,253 | B1 * | 7/2023 | Axe | A63B 21/4035 33/379 |
| 12,257,470 | B1 * | 3/2025 | Milich | A63B 21/151 |
| 2013/0288862 | A1 | 10/2013 | Lien | |
| 2017/0266479 | A1 * | 9/2017 | McCall | A63B 15/00 |
| 2022/0339487 | A1 * | 10/2022 | Dickstein | A63B 21/0722 |
| 2023/0173326 | A1 | 6/2023 | Yao | |

* cited by examiner

*Primary Examiner* — Andrew S Lo
(74) *Attorney, Agent, or Firm* — Brennan, Manna & Diamond, LLC

(57) ABSTRACT

A two-handed dumbbell lifting device is disclosed for picking up, using, and moving dumbbells. The two-handed dumbbell lifting device comprises a two-piece body that can be attached to a dumbbell handle or bar, and a pair of grips attached to opposing sides of the body providing a left and right grip for the user. The two-handed dumbbell lifting device also comprises various pivot points that enable the grip to tilt at selected positions and further will enable the grip to rotate along different degrees of axis as related to the body. The two-handed dumbbell lifting device also comprise a locking feature that will lock the two body halves together around the existing dumbbell handle or bar.

20 Claims, 11 Drawing Sheets

TWO-HANDED DUMBBELL GRIP

CROSS-REFERENCE TO RELATED APPLICATION

The present application claims priority to, and the benefit of, U.S. Provisional Application No. 63/596,777, which was filed on Nov. 7, 2023, and is incorporated herein by reference in its entirety.

FIELD OF THE INVENTION

The present invention relates generally to the field of weightlifting equipment. More specifically, the present invention relates to a gripping device for dumbbells or barbells to aid in the lifting and use of the weighted devices. When lifting a dumbbell, the users grip can often become tired and weak. This may lead to a sudden drop of the weight causing injury to the user or damage to items left on the floor. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in the lifting, moving, and use of dumbbells. Generally, dumbbells are lifted by hand, requiring the user to grip the middle portion of the dumbbell. The grip must be tight, or the dumbbell will fall from the user's hand. Because dumbbells vary in weight, and the goal is to progressively increase the weight used, users will often pick up weights that are heavier than they are used to lifting. Users need a better way to grip dumbbells for lifting, moving, and using.

In addition, when the dumbbell is in use, the user may find that their grip loosens over the course of the exercise due to fatigue. This fatigue can cause wrist pain which can eventually prevent the user from using dumbbells altogether. The device will provide the users with a method of using the dumbbell for the same exercise while maintaining a two-handed grip.

Further, a poor grip can lead to improper muscle development, and even lead some individuals to become disappointed with their progress. Because the handles on existing dumbbells are fixed in nature, the user is often forced to adapt the form of their exercise to the dumbbell. The device will enable the user a more ergonomic way of using the dumbbell due to its rotating grips. Further dumbbells are usually made of metal and as such can rip or tear skin on the hands. The device will enable the user to have nonmetal grips, greatly reducing the wear on the skin of the hands.

Accordingly, there is a demand for a device that improves the grip for users on dumbbell exercises reducing fatigue and accidents. More particularly there is a demand for a device that will enable a user to use dumbbells with a two-handed grip and be easily moved from one dumbbell to another.

Therefore, there exists a long-felt need in the art for a two-handed dumbbell grip that provides the user with an easier way to pick up, use, and move dumbbells. There is also a long felt need in the art for a two-handed dumbbell grip with a foldable grip that will enable the user to easily attach the device to any dumbbell. Further there is a long felt need in the art for a two-handed dumbbell grip that has a quick release feature to enable the user to quickly remove the grip from the dumbbell. Moreover, there is a long felt need in the art for a two-handed dumbbell grip that enables the user to reduce fatigue on the hand and wrist by use of rotating grips.

The subject matter disclosed and claimed herein, in one embodiment thereof, comprises a two-handed dumbbell grip device. The device is a two-handed dumbbell grip for lifting, using and moving dumbbells of different shapes and sizes. The device is comprised of a body which is in the shape of a hollow cylinder, and opens up axially into two separate halves, a left body and a right body, and a hinge which attaches the two halves axially. The device also comprises a left arm handle base which is a bar, including a rectangular shape, and attached to the left device body with a rotating feature. The device further comprises two left arm handles which are shaped as a general rectangular bar and are attached at each end of the left arm handle base. The device further comprises a left grip which is cylindrical in shape and attached at each end to the left arm handles. The device also comprises a right arm handle base which is a bar, including a rectangular shape, and attached to the right device body with a rotating feature. The device further comprises two right arm handles which are shaped as a general rectangular bar and are attached at each end of the right arm handle base. The device further comprises a right grip which is cylindrical in shape and attached at each end to the right arm handles.

In this manner, the two-handed dumbbell grip device of the present invention accomplishes all the forgoing objectives and provides users with a device that enables them to pick up, use, and move dumbbells easily and without injury to the user.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a two-handed dumbbell grip. The device enables two-handed operation for lifting, using, and moving dumbbells or similar products. The two-handed lifting device is comprised of a left body and a right body, connected by a body hinge and a body latch. A locking feature release button unlocks the device when attached to a dumbbell or similar object.

The left body includes a left rotating handle axis point connected to a left handle assembly base. A left handle arm assembly is fixed to the left handle base, and a left grip is positioned at the top of the arm assembly. The right body features a right rotating handle axis point attached to a right handle assembly base. A right handle arm assembly connects to the right handle base, with the right grip positioned at the top of the arm assembly. Both handle assembly bases rotate 360 degrees around the respective device bodies and can be locked in place using rotating handle lock assemblies. Each base has a locking mechanism including a spring-loaded locking pin for engaging one of three locking pin holes to set the rotation angle.

The left body and right body are joined by spacer bushings, forming a spacer bushing that secures the device to a dumbbell or similar product.

The handle arm assemblies are connected to their respective handle bases using a total of eight pivot pins, allowing for secure attachment to the combined left and right bodies. The handle grips can be individually adjusted by pressing a locking pin on the handle arm assemblies, equipped with a spring, to engage one of the locking pin holes. Each handle arm assembly includes an upper interlocking carriage, which moves within a lower interlocking carriage base, allowing the handles to tilt by sliding vertically toward or away from along the handle assembly bases or along the dumbbell bar.

The left handle grip and right handle grip are pivotally connected to their respective handle base assemblies.

In one embodiment, the device consists of two adjustable handle assemblies, each capable of independent upward or downward adjustment. This is achieved by disengaging the locking pin and selecting one of three locking pin holes to change the handle angle. Each handle assembly features an upper interlocking carriage that moves within a lower interlocking carriage base for angle adjustment.

In another embodiment, the left body and right body are secured around a dumbbell using reciprocating fasteners, which may include hinge and latch mechanisms, alignment dowels, screw bolts or locking pins. Each half may also have removable interchangeable sized spacers to accommodate various dumbbell sizes and styles.

Accordingly, the two-handed dumbbell grip device of the present invention is particularly advantageous as it provides the user with the ability to use two hands to lift, move, and use a dumbbell. In this manner, the two-handed dumbbell grip device overcomes the limitations of existing methods and devices used to pick up, use, and move dumbbells known in the art. Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
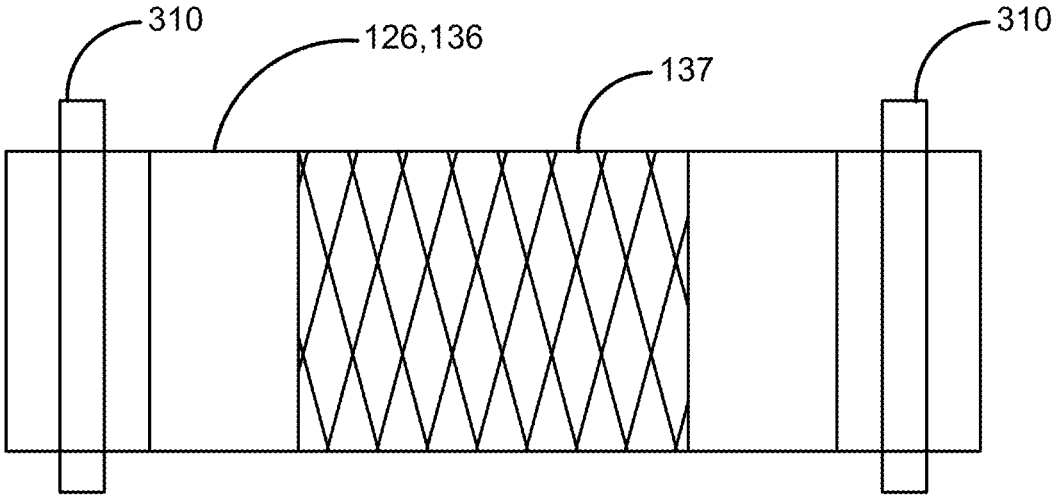
FIG. 1 illustrates a top view of one embodiment of a two-handed dumbbell grip device of the present invention showing each side of two handles looking at the ends of the device and showing a top view of the Handle Grip in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, therefore, there exists a long-felt need in the art for a two-handed dumbbell grip device that provides users with an easy way to pick up, move and use dumbbells. There is also a long felt need in the art for a two-handed dumbbell grip with separating halves or a lockable split hinge opening between the grips that will enable the user to easily attach the grip to any dumbbell. Further there is a long felt need in the art for two-handed dumbbell grip that has a quick release feature to enable the user to quickly remove the grip from the dumbbell. Moreover, there is a long felt need in the art for a two-handed dumbbell grip that enables the user to reduce fatigue on the hand and wrist by use of rotating, tilting, or adjustable grips.

Figure 2:
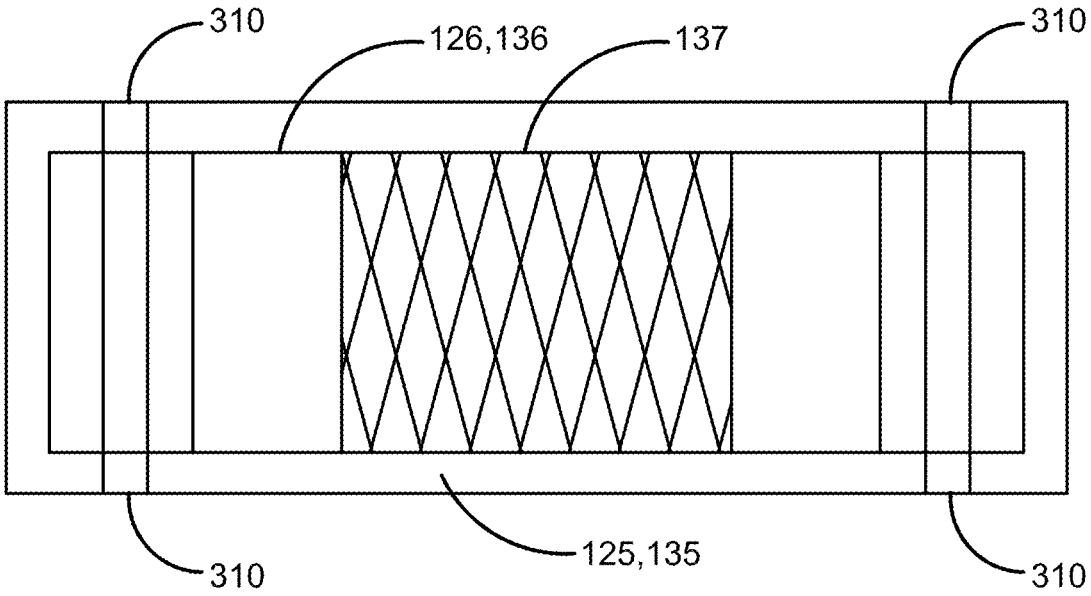
FIG. 2 illustrates a top view of one embodiment of a two-handed dumbbell grip device of the present invention showing each side of two handles looking at the ends of the device and showing a Handle Grip over the Handle Base Assembly on the right side and Left side including the attaching Pivot Pins at each end in accordance with the disclosed architecture.
Figure 3:
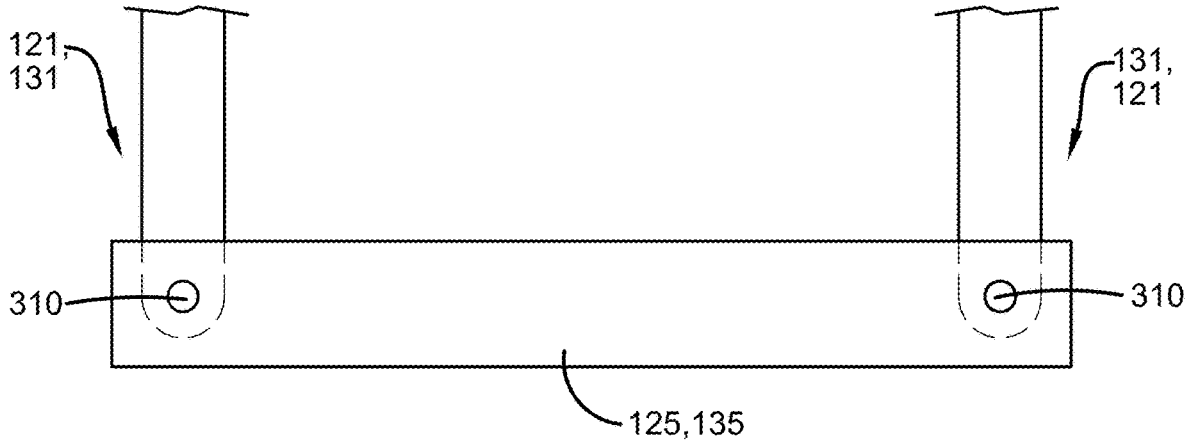
FIG. 3 illustrates a side view of one embodiment of a two-handed dumbbell grip device of the present invention that includes two separate Handle Base Assemblies that are attached to the Handle Arm Assemblies of each separate adjustable Handle Assembly by the Pivot Pins at each end in accordance with the disclosed architecture.
Figure 4:
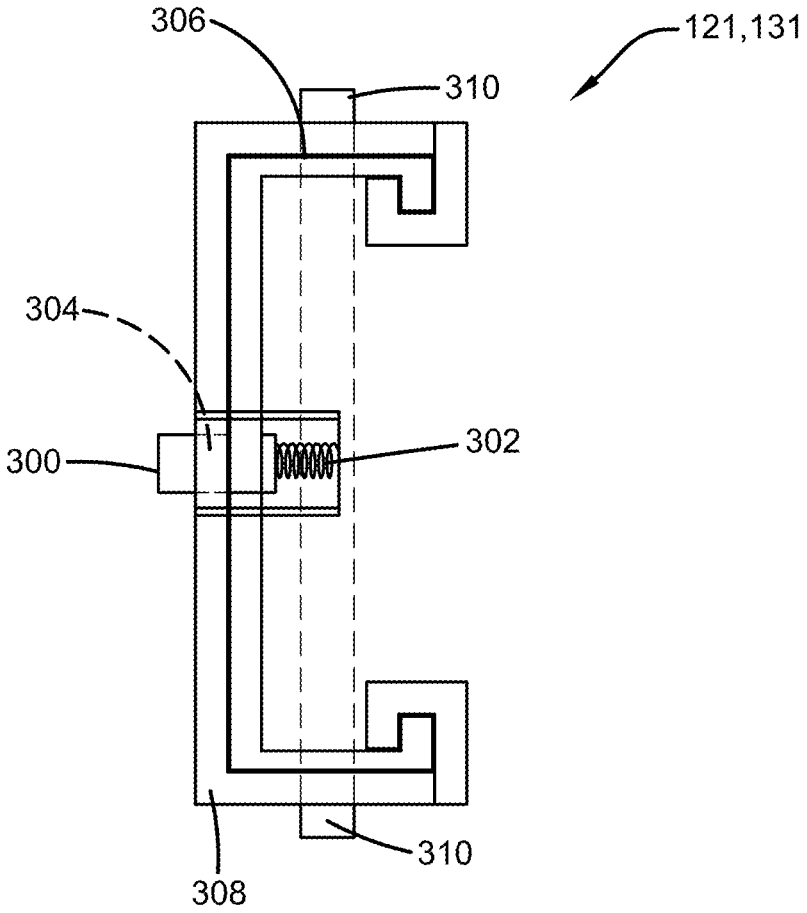
FIG. 4 illustrates a top view of one embodiment of a two-handed dumbbell grip device of the present invention showing the adjustable Left Handle Arm Assembly or Right Handle Arm Assembly for each device handle, showing the Inner and Outer Carriage interlocking slide feature that tilts each handle by depressing or unlocking the pin within one of the three adjustment holes in accordance with the disclosed architecture.
Figure 5:
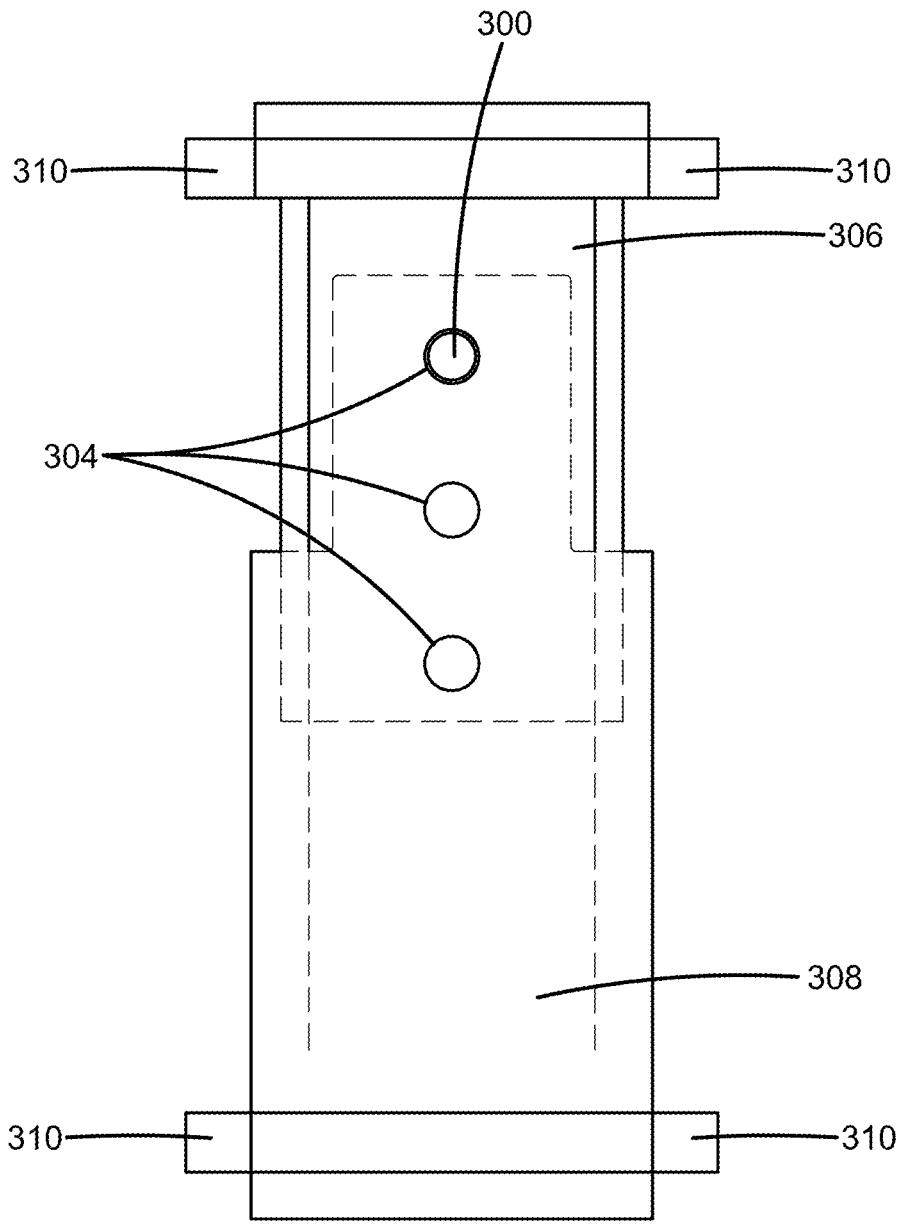
FIG. 5 illustrates a front view of one embodiment of a two-handed dumbbell grip device of the present invention showing the Adjustable Handle Assembly cutaway, Upper and Lower interlocking Carriage assembly with depressing Locking Pin, showing adjustment Locking Pin Holes in accordance with the disclosed architecture.
Figure 6:
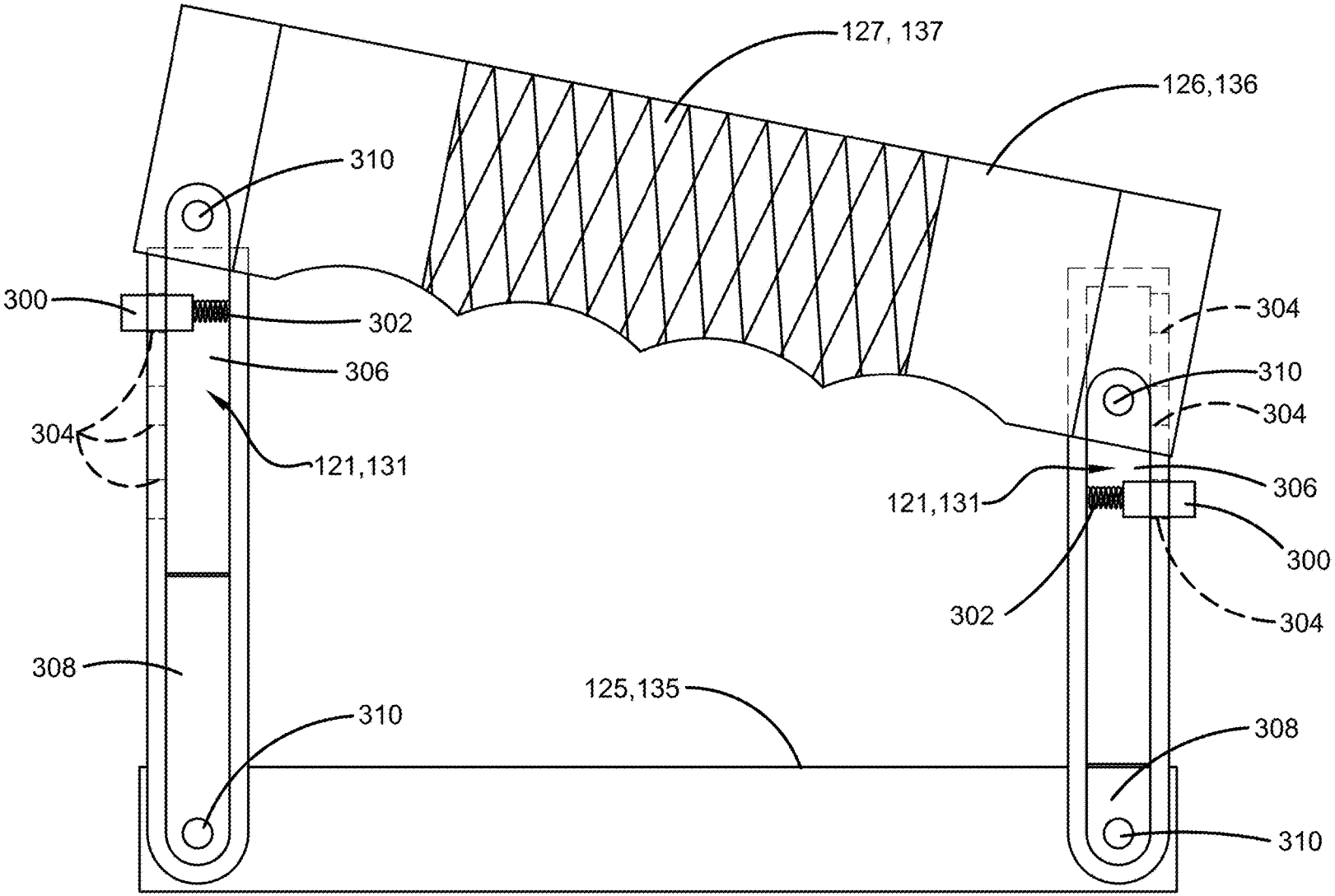
FIG. 6 illustrates a side view of one embodiment of a two-handed dumbbell grip device of the present invention showing one handle tilting feature in action while upper carriages, are connected by Pivot Pins to one of each of the Handle Grips and is connecting to the lower carriages by pivot pins, to each end of the Handle Assembly Bases in accordance with the disclosed architecture.
Figure 7:
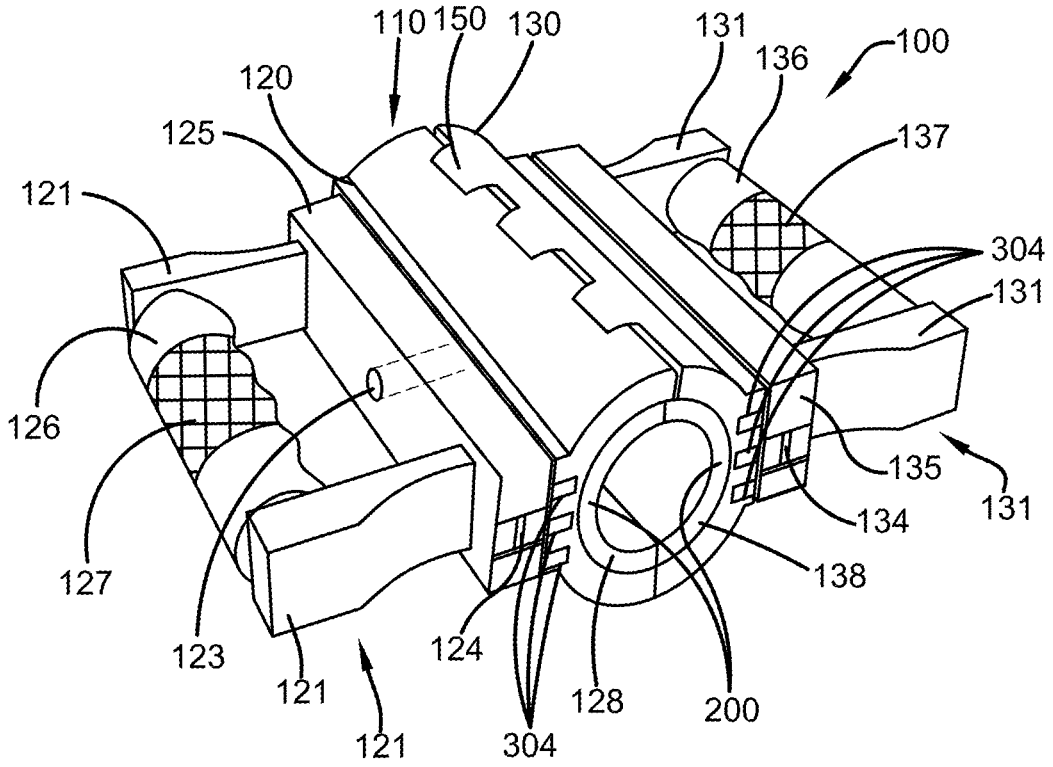
FIG. 7 illustrates a perspective view of one embodiment of a two-handed dumbbell grip device of the present invention in accordance with the disclosed architecture.
Figure 8:
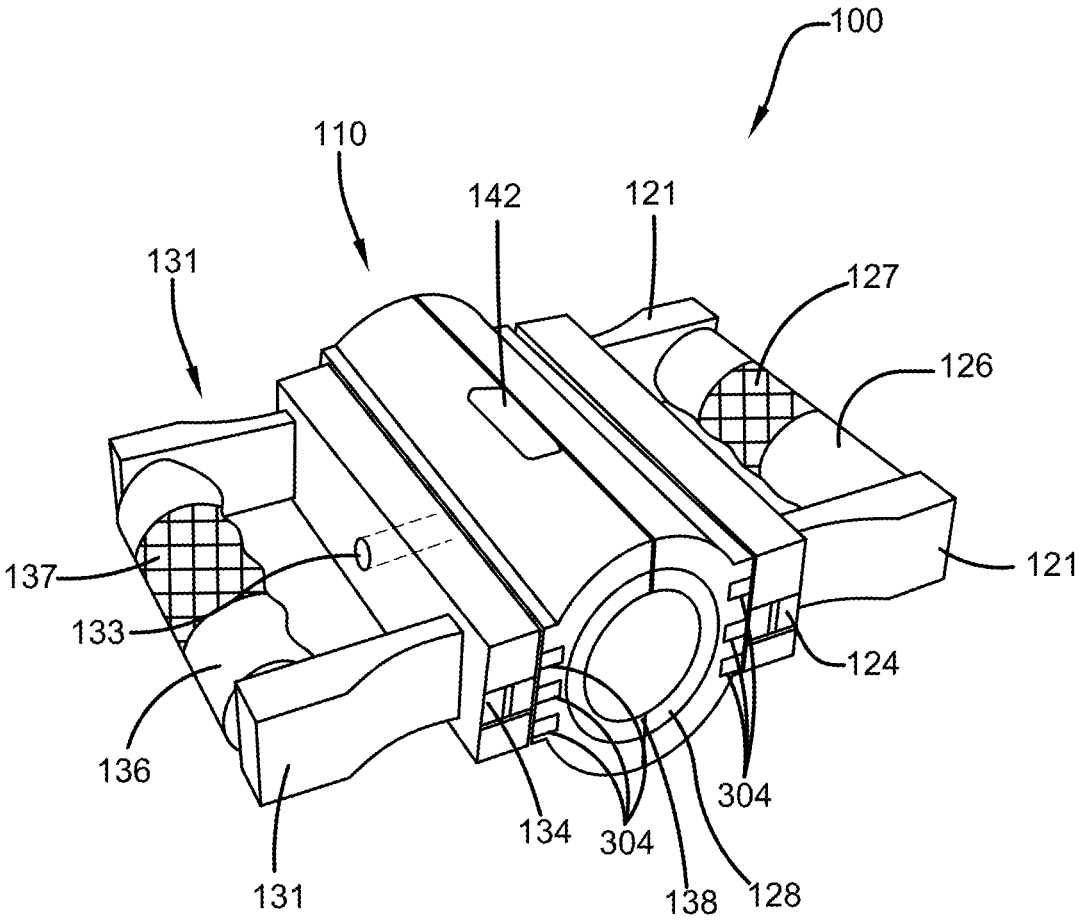
FIG. 8 illustrates a perspective view of one embodiment of a two-handed dumbbell grip device of the present invention in accordance with the disclosed architecture.
Figure 9:
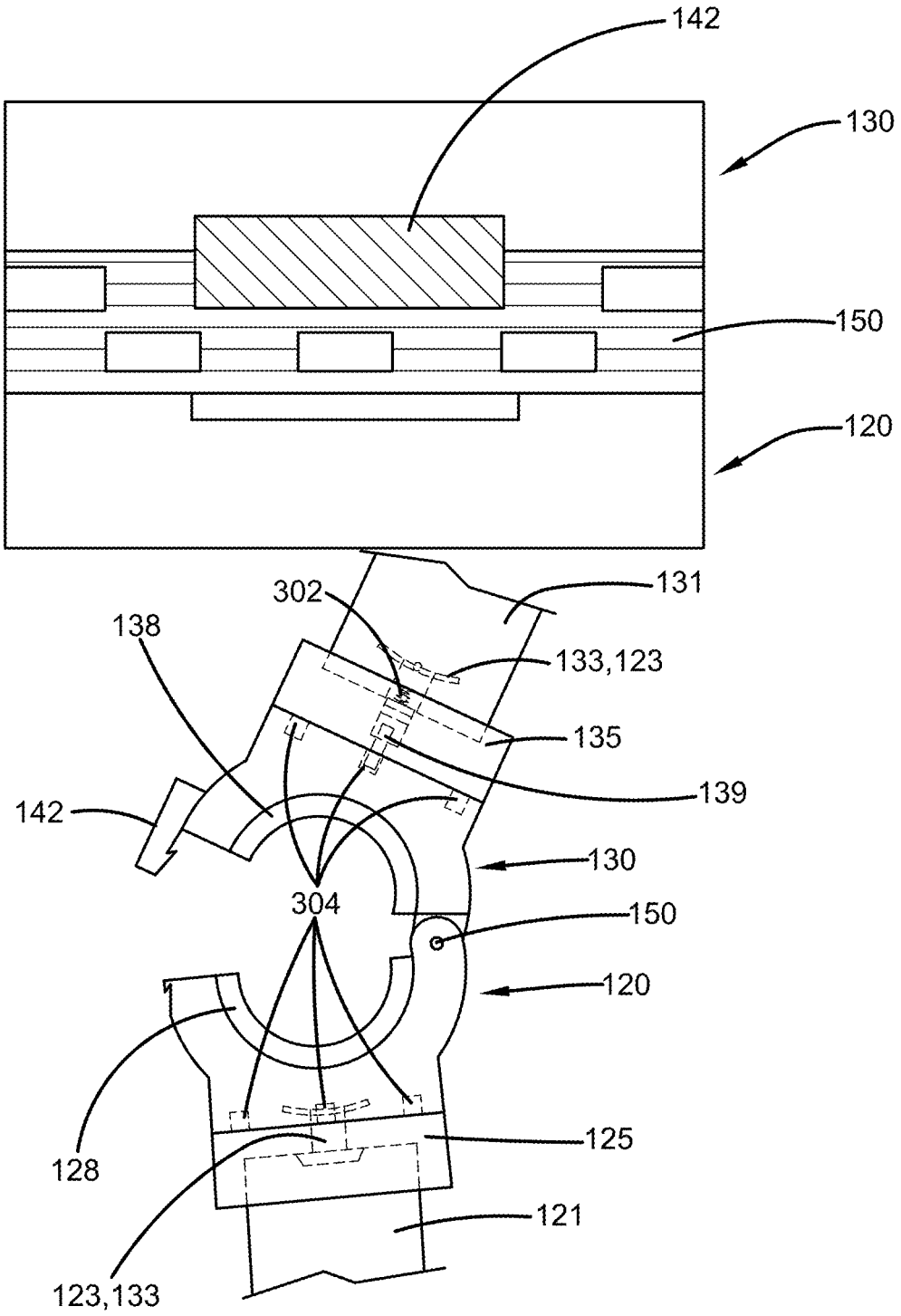
FIG. 9 illustrates a cross-sectional view of one embodiment of a two-handed dumbbell grip device of the present invention showing one of both Rotating Handle Axis Points and the Hinge and Latch, Rotating Handle Lock Assembly and the Locking Pin in accordance with the disclosed architecture.
Figure 10:
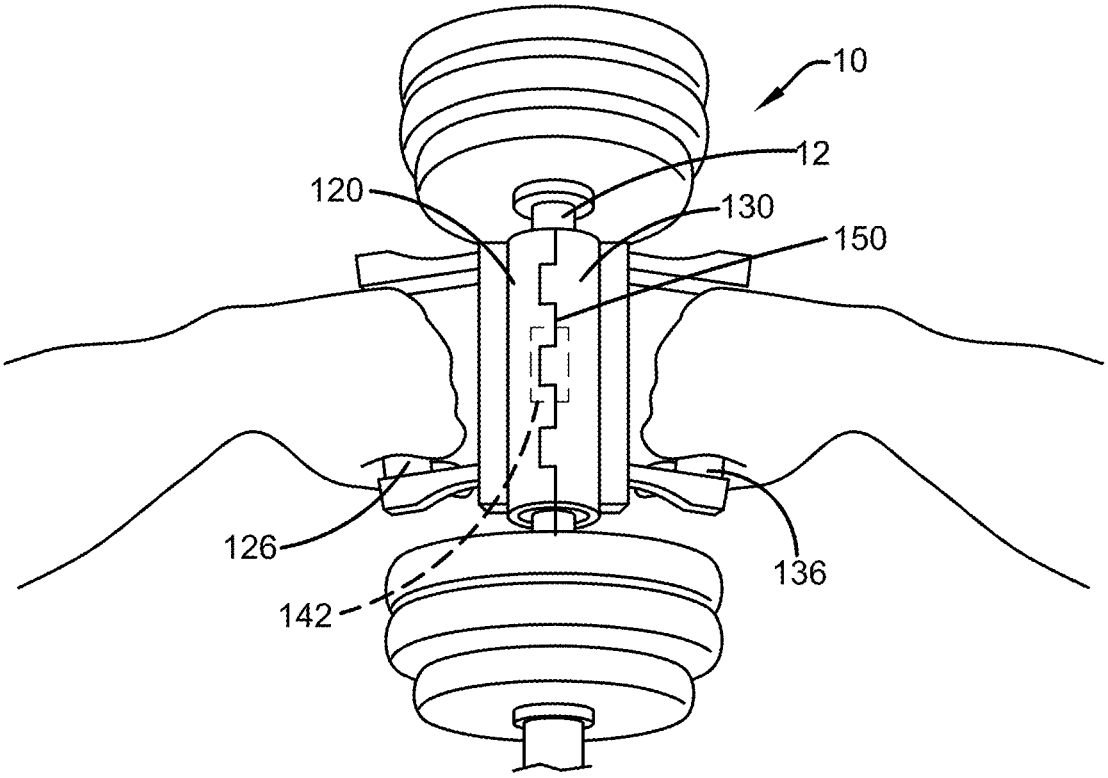
FIG. 10 illustrates a perspective view of one embodiment of a two-handed dumbbell grip device of the present invention in accordance with the disclosed architecture.
Figure 11:
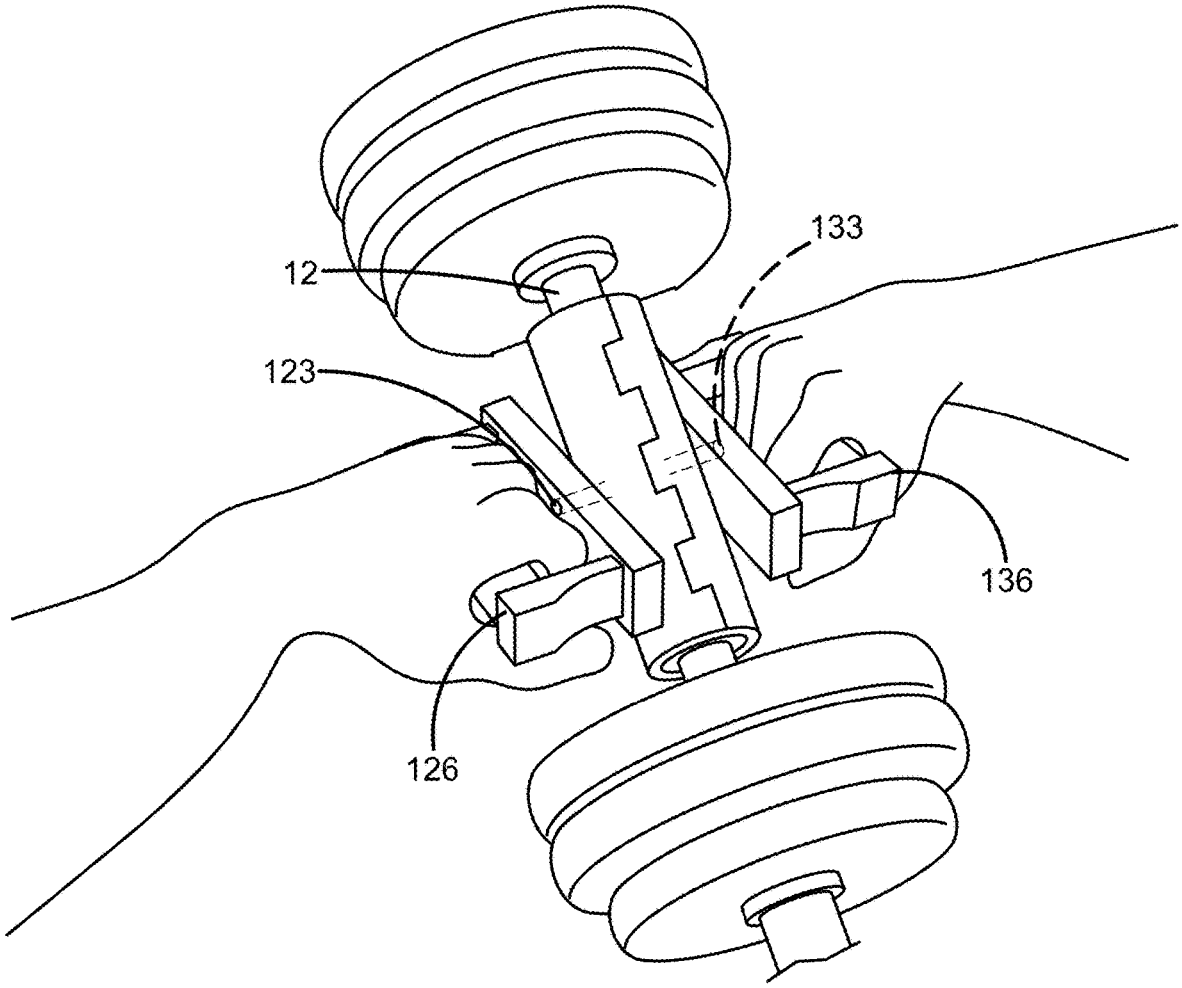
FIG. 11 illustrates a perspective view of one embodiment of a two-handed dumbbell grip device of the present invention in accordance with the disclosed architecture.

Referring initially to the drawings, FIG. 1-11 illustrates various views of one embodiment of the device 100 of the present invention. The device 100 provides the user with a device 100 that will enable for the two-handed pick up, use, and movement of dumbbells or like products. Specifically, the two-handed dumbbell lifting device 110 comprises a jointed left body 120 and a right body 130 joined together by body hinge 150 and body latch 142. Further, a locking feature release button 142 is present for unlocking the device 100 once attached to a dumbbell or like product.

The Left Device Body 120 is also comprised of a left rotating Handle Axis Point 123 that attaches to a Left Handle Assembly Base 125.

The Left Handle Arm Assembly 121 is attached to the Left Handle Base 125 at the furthest ends. In addition, a Left Grip 126 with a Grip Texture 127 is attached to the top of the Left Handle Arm Assembly 121. A Right Device Body 130 is comprised of a Right Rotating Handle Axis Point 133 that attaches to a Right Handle Assembly Base 135. A Right Handle Arm Assembly 131 is attached to the Right Handle Base 135 at the furthest ends. In addition, a Right Grip 136 with a Grip Texture 137 is attached to the top of the Right Handle Arm Assembly 131. Each Handle Assembly Base 125,135 can rotate 360 degrees around Left and Right Device Bodies 120,130 from the attached Rotating Axis Point 123,133. Each Handle Assembly Base 125,135 while rotating, can be locked into position by the Rotating Handle Lock Assembly 124,134 at each end. Each Handle Base Assembly 125,135 has a Spring 302 Loaded Handle Locking Pin 139 that allows the user to engage one of three Locking Pin Holes 304 to select the desired Degree of Rotation.

The Left Body portion 120 and the Right Body portion 130 comprised of a Spacer/Bushing 128,138 that are joined together to form a Spacer Bushing 200 to secure and fit Device 100 to a Dumbbell Handle 12 or like products.

The Left Handle Arm Assembly 121 is attached to the Left Handle Base Assembly 125 and the Right Handle Arm Assembly 131 is attached to the Right Handle Base Assembly 135. Both Assemblies 121,131 are joined together by a total of eight Pivot Pins 310 for two Handle Assemblies 125,135 or four Pivot Pins 310 for each separate Handle Assembly 125,135. All are further attached to the combined Left Body 120 and Right Body 130. Each of two Handle Arm Assemblies 121,131 can affect the angle of the Handle Grips 126,136 that can be separately adjusted upwards or downwards via pressing at least one locking mechanism including a locking pin 300 comprised of at least one spring 302 to allow the spring loaded pin 300 to allow each spring loaded pin 300 to engage or lock into at least one of three Locking Pin Holes 304 positioned on the Handle Arms 121,131 to change the length or angle of each Handle Grip 126,136. More specifically, each Handle Arm Assembly 121,131 is comprised of an Upper Interlocking Carriage 306 that moves within a Lower Interlocking Carriage base 308 and adjusts by depressing or unlocking the Carriage Locking Pin 300 within one of the adjustment Holes 304. Allowing the Handles 126,136 to securely tilt by sliding laterally up or down from their Handle Assembly Bases 125,135 or bar of the attached dumbbell. Using the Adjustable Upper Interlocking 306 and Lower Interlocking Carriage 308 design.

The Left Handle Grip 126 is pivotally connected to the Left Handle Base Assembly 125 and the Right Grip 136 is pivotally connected to the Right Handle Base Assembly 135.

In one embodiment, the device 110 is comprised of two handles assemblies 121,131. Each handle assembly 121, 131 can be separately adjusted upwards or downwards via pressing at least one locking pin 300 comprised of at least one spring 302 to allow the pin 300 to disengage the pin 300 to engage at least one, but preferably three locking pin holes 304 positioned on the Handle Arm Assemblies 121,131 to change the angle of each Handle 126,136. More specifically, each handle assembly 121,131 is comprised of an upper interlocking carriage 306 that moves within a lower interlocking carriage base 308 design and adjusts by depressing the pin 300 to lock within one of the three holes 304.

In one embodiment, the left body 120 and the right body 130 attach together around a dumbbell via reciprocating fasteners 142, 150 such as but not limited to male and female hinge and latch fasteners, alignment dowels, screw bolts and/or locking pins. In one embodiment, each half is comprised of at least one custom removable spacer 128,138 to allow for attachment of the bodies 120,130 to fit around various dumbbell styles.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "Two-handed dumbbell lifting device" and "device" are interchangeable and refer to the two-handed dumbbell lifting device 100 of the present invention.

Notwithstanding the forgoing, the two-handed dumbbell lifting device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the two-handed dumbbell lifting device 100 as shown in the FIGS. are for illustrative purposes only, and that many other sizes and shapes of the two-handed dumbbell lifting device 100 are well within the scope of the present disclosure. Although the dimensions of the two-handed dumbbell lifting device 100 are important design parameters for user convenience, the two-handed dumbbell lifting device 100 may be of any size, shape, and/or configuration that ensures optimal performance during use, and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A two-handed dumbbell lifting device comprising:

a left body comprised of a first spacer and a right body comprised of a second spacer, the first spacer and the second spacer configured to join and form a spacer bushing;

a left handle assembly comprising:

a first handle base pivotally connected to the left body via a first rotating handle axis point, enabling rotation of the left handle assembly relative to the left body;

a first tilting handle arm assembly attached to the left handle base configured to adjust an angle of a first grip on the first tilting handle arm assembly;

a first rotating handle lock assembly associated with the left handle base, configured to lock the rotation of the left handle base at a selected position;

a right handle assembly comprising:

a second handle base pivotally connected to the right body via a second rotating handle axis point, enabling rotation of the right handle assembly relative to the right body;

a second tilting handle arm assembly attached to the right handle base configured to adjust an angle of a second grip on the second tilting handle arm assembly; and a second rotating handle lock assembly associated with the right handle base, configured to lock the rotation of the right handle base at a selected position.

2. The two-handed dumbbell lifting device of claim 1, wherein the first tilting handle arm assembly is comprised of a first spring-loaded locking pin.

3. The two-handed dumbbell lifting device of claim 2, wherein the first spring-loaded locking pin engages with a first locking pin hole to adjust a tilt angle of the left handle assembly.

4. The two-handed dumbbell lifting device of claim 1, wherein the second tilting handle arm assembly is comprised of a second spring-loaded locking pin.

5. The two-handed dumbbell lifting device of claim 4, wherein the second spring-loaded locking pin engages with a second locking pin hole to adjust a tilt angle of the right handle assembly.

6. The two-handed dumbbell lifting device of claim 1, wherein the first spacer is comprised of a half cylindrical shape.

7. The two-handed dumbbell lifting device of claim 1, wherein the second spacer is comprised of a half cylindrical shape.

8. A two-handed dumbbell lifting device comprising:

a left body portion comprising a first spacer and a right body portion comprised of a second spacer;

a left handle assembly comprising:

a first handle base that is rotatably mounted to the left body portion and pivotable around a first axis point to adjust a rotational angle of the left handle assembly;

a first tiltable handle arm assembly attached to the first handle base, wherein the first handle arm assembly includes a first grip and is configured to tilt relative to the first handle base;

a first locking mechanism configured to secure the rotation of the left handle base to a first predetermined angle;

a right handle assembly comprising:

a second handle base that is rotatably mounted to the right body portion and pivotable around a second axis point to adjust a rotational angle of the right handle assembly;

a second tiltable handle arm assembly attached to the second handle base, wherein the second handle arm assembly includes a second grip and is configured to tilt relative to the second handle base; and a second locking mechanism configured to secure the rotation of the right handle base to a second predetermined angle.

9. The two-handed dumbbell lifting device of claim 8, wherein the left handle base rotates independently from the right handle base.

10. The two-handed dumbbell lifting device of claim 8, wherein the left handle assembly is comprised of a first upper interlocking carriage and a first lower interlocking carriage base.

11. The two-handed dumbbell lifting device of claim 8, wherein the right handle assembly is comprised of a second upper interlocking carriage and a second lower interlocking carriage base.

12. The two-handed dumbbell lifting device of claim 8, wherein the first locking mechanism is comprised of a spring-loaded locking pin.

13. The two-handed dumbbell lifting device of claim 8, wherein the second locking mechanism is comprised of a spring-loaded locking pin.

14. A two-handed dumbbell lifting device comprising:

a left body comprised of a first spacer and a right body comprised of a second spacer, the first spacer and the second spacer configured to join and form a spacer bushing;

a left handle assembly comprising:

a first rotatable handle base that pivots around a first axis point attached to the left body;

a first handle arm assembly that tilts relative to a first handle base to adjust a first angle of a first grip attached to the first handle arm assembly; and a first locking pin configured to secure the left handle assembly in a rotational position or a tilting position;

a right handle assembly comprising:

a second rotatable handle base that pivots around a second axis point attached to the right body;

a second handle arm assembly that tilts relative to a second handle base to adjust a second angle of a second grip attached to the second handle arm assembly; and a second locking pin configured to secure the right handle assembly in a rotational position or a tilting position.

15. The two-handed dumbbell lifting device of claim 14, wherein the first handle arm assembly is comprised of a first locking mechanism.

16. The two-handed dumbbell lifting device of claim 15, wherein the first locking mechanism is comprised of the first locking pin and a spring.

17. The two-handed dumbbell lifting device of claim 14, wherein the second handle arm assembly is comprised of a second locking mechanism.

18. The two-handed dumbbell lifting device of claim 14, wherein the second locking mechanism is comprised of the second locking pin and a spring.

19. The two-handed dumbbell lifting device of claim 14, wherein the left handle assembly is comprised of a first pivotable grip.

20. The two-handed dumbbell lifting device of claim 14, wherein the right handle assembly is comprised of a second pivotable grip.

* * * * *